United States Patent [19]

Hamlett et al.

[11] 4,099,474

[45] Jul. 11, 1978

[54] CONVERTIBLE OPEN-ARM SEWING MACHINE

[75] Inventors: Sidney J. Hamlett, Parma; Charles M. Bell, Olmsted Falls, both of Ohio

[73] Assignee: White Sewing Machine Company, Cleveland, Ohio

[21] Appl. No.: 747,968

[22] Filed: Dec. 6, 1976

[51] Int. Cl.[2] ..... D05B 73/06

[52] U.S. Cl. ..... 112/258

[58] Field of Search ..... 112/258, 260, 217.1; 312/24, 26, 27, 28, 29, 30

[56] References Cited

U.S. PATENT DOCUMENTS

| | | | |
|---|---|---|---|
| 2,398,697 | 4/1946 | Colegrove | 112/260 |
| 2,409,758 | 10/1946 | Hohmann et al. | 112/260 |
| 3,986,755 | 10/1976 | Kohara | 312/26 X |

FOREIGN PATENT DOCUMENTS

| | | | |
|---|---|---|---|
| 957,419 | 8/1949 | France | 112/260 |

*Primary Examiner*—George H. Krizmanich

*Attorney, Agent, or Firm*—McNenny, Pearne, Gordon, Gail, Dickinson & Schiller

[57] ABSTRACT

A sewing machine convertible between flat bed and cylinder bed configurations and adapted to be mounted in cabinets of conventional design. The machine includes a base cabinet arranged to alternately support a lower cylinder arm flush with a cabinet top for flat work and at an elevated position above the cabinet top for tubular work. An auxiliary work supporting surface for flat work is responsive to relative movement between the machine frame and the support base such that it automatically retracts or extends during positioning of the machine frame between its flat bed and free arm operational positions. Counterbalancing means is provided to reduce manual effort of raising or lowering the machine between operational positions.

7 Claims, 8 Drawing Figures

Fig. 1
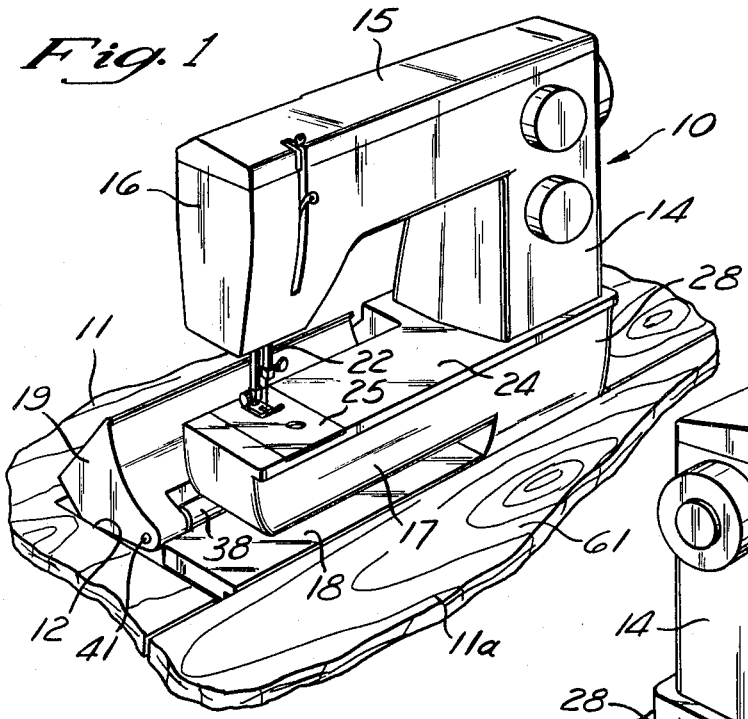
Fig. 2
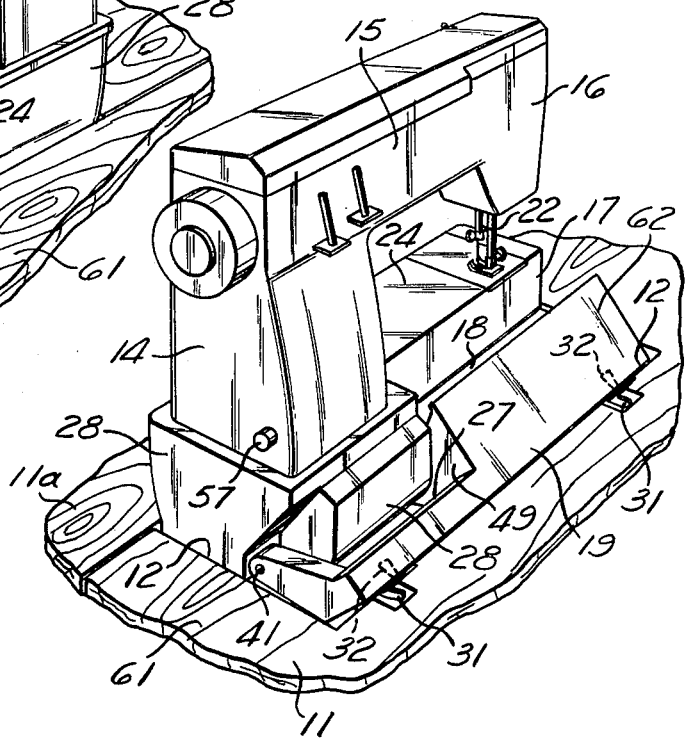
Fig. 3
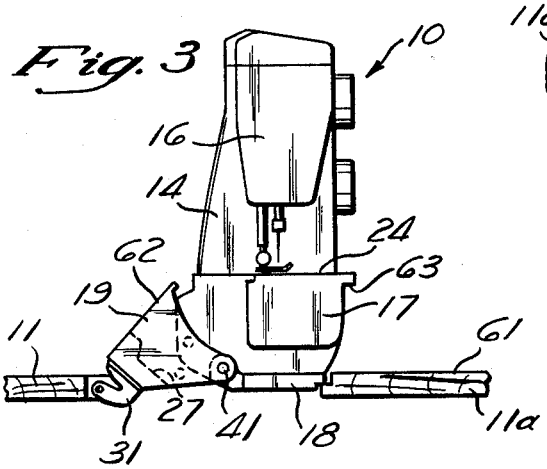
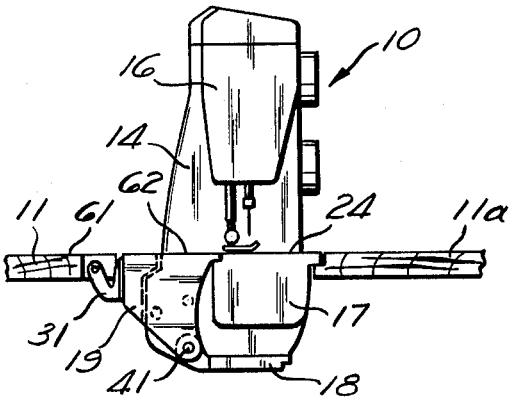
Fig. 4
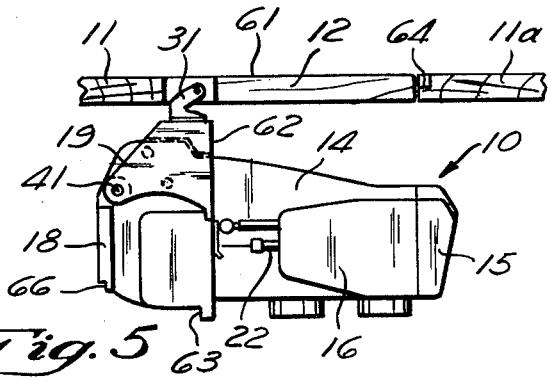
Fig. 5

CONVERTIBLE OPEN-ARM SEWING MACHINE

BACKGROUND OF THE INVENTION

The invention relates to sewing machines and in particular to a type of machine which is convertible between flat bed and open arm configurations.

PRIOR ART

Conventional sewing machines of the type to which the present invention is directed typically include a lower free arm or cylinder bed and an auxiliary structure movable with respect to the arm to increase or convert the horizontal work supporting surface area over that provided by the arm when sewing flat work. Broadly stated, in the prior art there have developed two classes of units, convertible between free arm and flat bed configurations, corresponding to the classification of portable and cabinet-mounted machines. For conversion, portable machines have ordinarily utilized simple auxiliary support surfaces pivotal or slidable with respect to the free arm.

Prior convertible machines intended for cabinet mounting, on the other hand, have generally not been compatible with existing standardized cabinets and have required speciallized designs and/or complex elevator mechanisms.

SUMMARY OF THE INVENTION

The invention provides a convertible open arm sewing machine for use in cabinets of existing standardized design without cabinet modification or resort to complex elevating mechanisms. The machine is adapted to be conventionally mounted on standardized hinge hardware in a normal manner. The standard cabinet hinges support the machine in both its flat bed and free arm operative positions, as well as its storage position.

As disclosed, the machine includes a pivotal support base providing a horizontal pivot axis parallel to the cabinet hinge axis. The pivot base allows a folding movement of a main frame of the machine relative to the cabinet hinges, and therefore the cabinet structure, so as to permit selection between a flat bed configuration and an elevated free arm position. Manually operable indexing means are provided to maintain the machine in either of its selected operational positions. Counterbalancing means carried on the machine minimizes manual effort expended in raising or lowering the machine between its operational positions.

BRIEF DESCRIPTION OF THE DRAWINGS

FIG. 1 is a perspective front view of a sewing machine embodying the principles of the invention;

FIG. 2 is a rear perspective view of the machine of FIG. 1;

FIG. 3 is an end elevational view of the machine of FIG. 1 in a free arm operational position;

FIG. 4 is an end elevational view of the machine in a flat operational position;

FIG. 5 is an end view of the machine in a retracted or storage position;

DESCRIPTION OF THE PREFERRED EMBODIMENT

Figure 6:
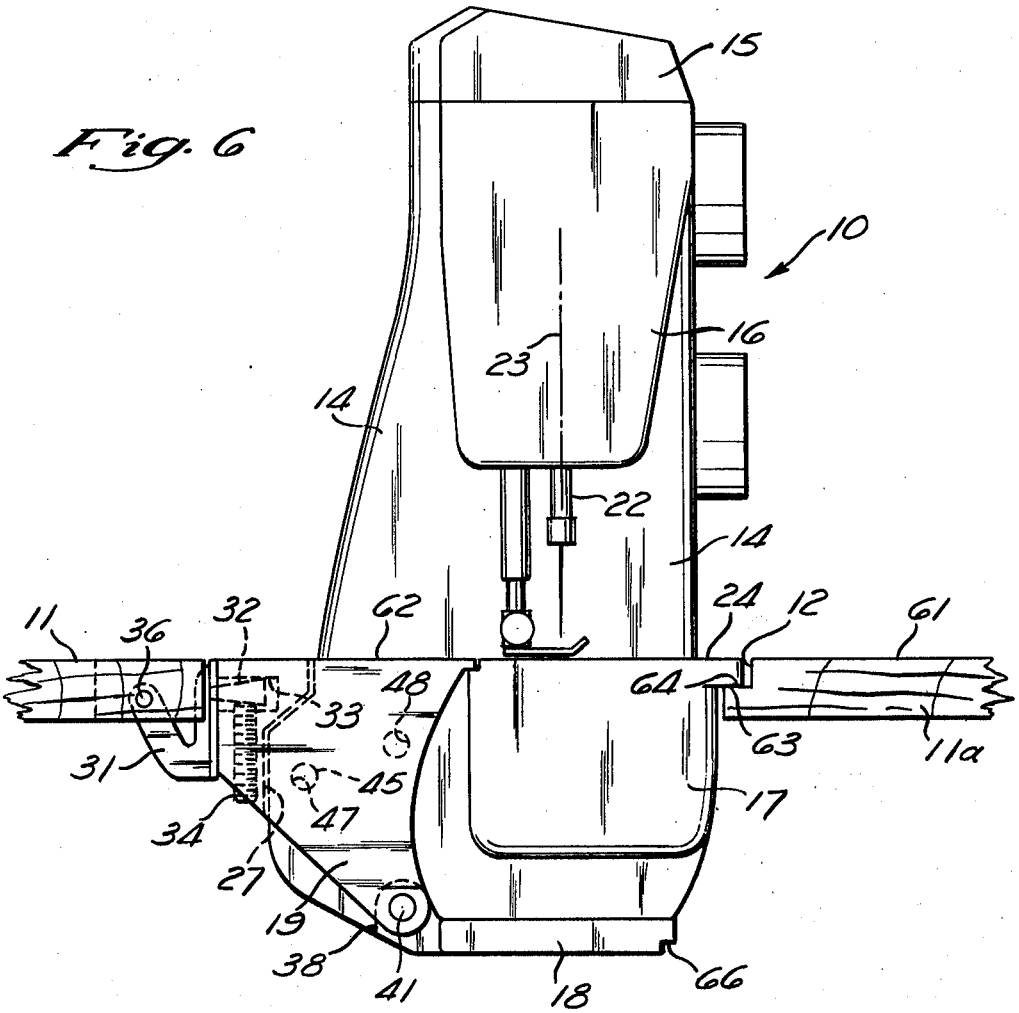
FIG. 6 is an end elevational view of the machine on an enlarged scale, showing constructional details thereof.

A sewing machine 10 is assembled on a conventional cabinet represented by a horizontal panel 11. The machine 10 in a customary manner is stored in the cabinet below the panel 11, or is disposed generally above the panel 11 over a generally rectangular cut-out 12 during use.

The machine 10 comprises a frame in which is housed conventional mechanism to develop desired stitching and work movement. The frame includes a vertical standard 14, a horizontal, upper arm 15, a sewing head 16 at the free end of the upper arm, a lower horizontal arm or cylinder bed 17, and a horizontal base plate 18 spaced beneath the lower arm. The above-enumerated portions of the frame are rigid with respect to one another, and may be formed as one or more cast or otherwise fabricated units, in accordance with usual manufacturing practice. A pivot base 19 of the machine 10 is pivotally connected to the machine frame by means disclosed hereinbelow.

The head 16 supports a needle bar 22 for vertical reciprocation along a vertical line or axis 23. The lower arm 17 is cantilever-supported at the standard 14 so that it extends freely without support along substantially its full length. An upper, horizontal surface 24, including a throat plate 25 on the arm 17, provides a primary work supporting surface.

The pivot base 19 extends longitudinally along the rear side of the machine. In the illustrated embodiment, the pivot base generally resembles a triangular prism having a notch 27 at one end for clearance around a base or bed portion 28 of the standard 14. The pivot base 19 in its illustrated form is fabricated as a metal casting, with a hollow interior to reduce weight while affording high rigidity. The pivot base 19 is pivoted on the cabinet panel 11 by means of standardized, commercially used hinges 31. Mounting pins 32 integral with the hinge structure (FIG. 6) are received in holes 33 spaced longitudinally on the pivot base 19 in alignment with the hinges 31, and are captured by setscrews 34. FIG. 2 illustrates the spacing of the hinges 31 lengthwise of the machine at an edge of the cut-out 12. Pivot centers 36 of the hinges 31 (only one is shown in FIG. 6) define a pivot axis for the base 19 parallel to the longitudinal or lengthwise direction of the machine 10 and within a plane of the panel 11.

The pivot base 19 is pivoted or hinged to the frame of the machine 10 at one end on an enlargement 38 integral with the base plate 18 and at the other end to the base or bed 28 of the standard 14. A circular rod 41 extends longitudinally of the machine through suitable cylindrical holes in the pivot base 19 and frame of the machine 10. The rod 41 defines an axis of relative pivotal movement between the base 19 and frame of the machine 10 extending parallel to the axis of the hinges 31. The pivot base 19 is adapted to alternately support the machine 10 at two operational positions: a frame arm position and a flat bed configuration comparatively illustrated in FIGS. 3 and 4, respectively.

Figure 8:
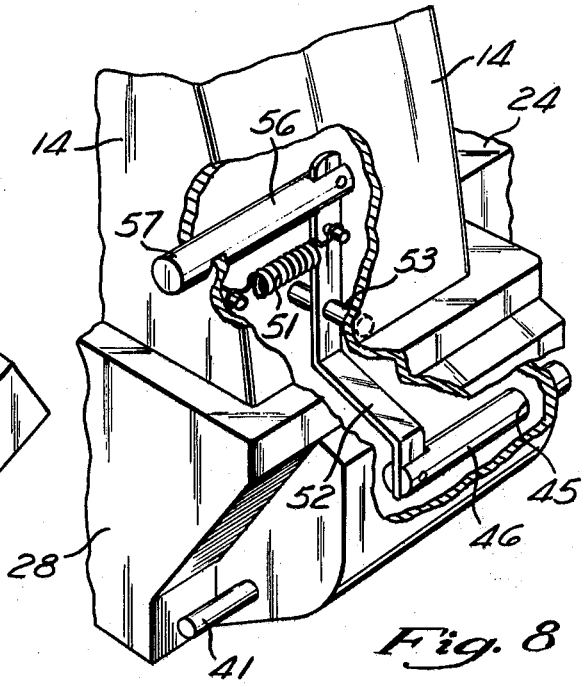
FIG. 8 is a perspective, fragmentary view of another portion of the standard end of the machine, illustrating details of means for indexing the machine at its operational positions.

A bolt or pin 46 mounted in the standard bed 28 is slidably guided by the surface of a cylindrical bore 45 within the rear of the standard base 28 and is adapted to be indexed into engagement with the surface of one or another of a pair of holes 47 and 48 in a vertical face 49 of the pivot base 19 associated with the notch 27. The bolt 46 is biased towards the holes 47 and 48 by a tension spring 51 operating on a lever 52 pivotal on a post 53 (FIG. 8). A shaft 56 has one of its ends connected to the lever 52 and its opposite end exposed through the wall of the standard to form a push button 57. The push button 57 is manually depressed towards the housing of the standard 14 against the force of the spring 51 to release the bolt 46 from either of the bolts 47 or 48 and allow relative pivotal movement between the base 19 and the frame of the machine 10, and thereby allow a change of the machine from one operational position to another.

In the lower or flat bed operational position of the machine 10 (FIGS. 4 and 6), the upper bed surface 24 is substantially coplanar with an upper surface 61 of the cabinet panel 11. At the same time, a planar surface 62 of the pivot base 19 is substantially coplanar with the lower arm surface 24, thereby forming an auxiliary work supporting surface. In this flat bed configuration, the pivot base 19 supports the machine 10 at its rear side, while a downwardly facing lip or surface 63 on the lower arm 17 supports the machine at its front side. The lip 63 at the front of the arm 17 is spaced slightly below the upper surface 24 of the arm and rests on a ledge 64 formed in the cut-out 12. As seen in FIG. 6, the combined widths of the upper surface 24 of the free arm and the adjacent pivot base surface 62 are substantially equal to the front-to-rear dimension of the cut-out 12 so as to close the cut-out in the flat bed configuration.

In the free arm position, the pivot base 19 similarly supports the rear side of the machine 10, while another downwardly facing lip surface 66 formed along the longitudinal lower front edge of the base plate 18 rests on the cabinet panel ledge 64. The vertical spacing of the lips 63 and 66 thereby corresponds to the distance which the arm or cylinder 17 is elevated above the panel 11. The lower lip 66 is disposed slightly rearwardly of the upper lip 63 to allow the machine to advance or move forwardly towards an operator when moved from the flat bed configuration to the free arm configuration. As suggested in FIG. 3, the cabinet panel cut-out 12 is substantially closed by the base plate 18 and the pivot base 19, thereby preventing objects from inadvertently falling through the cut-out.

Figure 7:
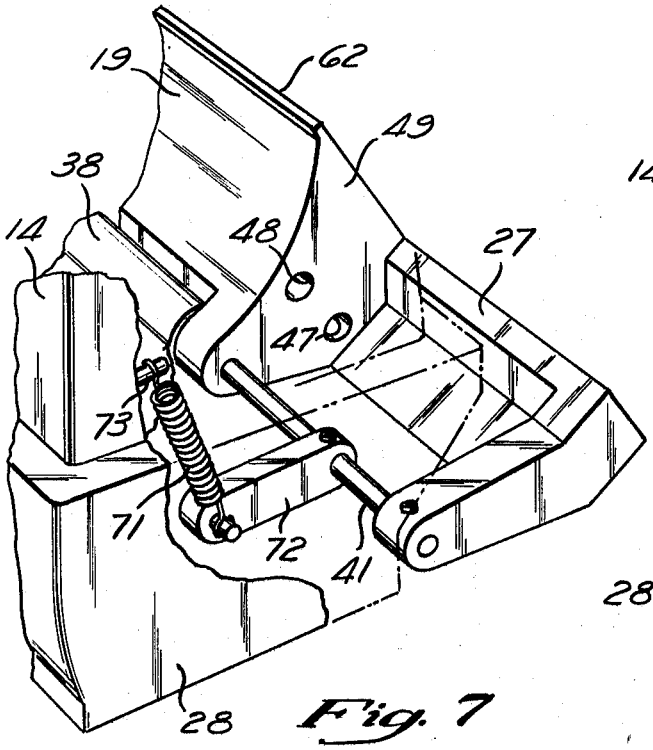
FIG. 7 is a perspective, fragmentary view of a portion of the standard end of the machine, illustrating details of means for counterbalancing the machine.

The weight of the frame of the sewing machine and mechanism contained therein is counterbalanced by a spring 71 (FIG. 7) contained within the vertical standard 14. One end of the tension spring 71 is connected to an arm 72 fixed to the pivot rod 41, as by a setscrew, while the pivot rod in turn is fixed to the pivot base 19, again by a setscrew. The opposite end of the spring 71 is anchored with a pin 73 to the standard 14. The effect of the spring 71 is to bias the angular position of the pivot base 19 and machine frame to that corresponding to the free arm position, i.e., the spring tends to swing the lower arm 17 away from the pivot base 19. Thus, when the machine frame is manually held in a generally vertical orientation with a lateral or horizontal force, the spring 71 urges the frame upwardly. The resultant reaction forces greatly reduce the effort required to manually raise and lower the machine between the flat bed configuration of FIG. 4 and the elevated free arm position of FIG. 3.

As illustrated in FIG. 6, the pivot axis of the rod 41 is preferably vertically below the lower arm 17 and horizontally in a zone between the axis of the hinges 31 and the lower arm, and ideally behind a plane of a rear face of the lower arm. The geometry of the pivot base 19 and kinematics produced by its two pivot axes, that of the hinges 31 and the rod 41, provides the advantages of automatic displacement of the secondary work supporting surface 62 to areas adjacent or remote from the lower arm 17, depending on the operational position of the machine and advancement or forward movement of the machine in the upper or free arm position from that of the flat bed position.

FIG. 5 illustrates the machine 10 in its storage position beneath the upper panel 11. The pivotal base 19 and frame of the machine 10 are locked in a relative angular position corresponding to the flat bed mode when in this storage condition. To raise the machine 10 into the flat bed position, a portion 11*a* of the cabinet panel is raised or otherwise displaced in a conventional manner, permitting passage of the machine through the plane of the panel 11. The machine 10 is then manually swung on the hinges 31 into the position of FIG. 4, likewise in a generally conventional fashion. Thereafter, the shiftable panel 11*a* is returned to the position illustrated in the figures. The free arm position of FIG. 3 is achieved by manually depressing the push button 57 and simultaneously manually exerting a vertical force on the sewing machine frame. With the button 57 released, the associated pin 46 will automatically index it to the hole 48 corresponding to the free arm position when the machine has been sufficiently elevated.

Although a preferred embodiment of this invention is illustrated, it is to be understood that various modifications and rearrangements of parts may be restored to without departing from the scope of the invention claimed herein.

What is claimed is:

1. An assembly comprising a cabinet and a sewing machine, said cabinet including a cabinet panel having an upper horizontal surface and a cut-out for reception of said machine, said sewing machine including as components a frame and a pivot base, said frame having a vertical standard, a horizontal upper arm extending from the standard, a sewing head at the free end of the upper arm, a lower cantilevered arm freely extending from a supported end thereof adjacent the standard and generally parallel to the upper arm, means for pivoting the pivot base on the cabinet about a first horizontal axis parallel to said lower arm, said pivot base including a means for pivotally supporting the machine frame about a second axis spaced from and parallel to said first axis, said pivot base and said cabinet panel being arranged to support said machine frame at two vertically spaced operational positions corresponding to a free arm or first position wherein said lower arm is elevated with respect to said horizontal cabinet surface and a flat bed or second position wherein an upper face of said lower arm is generally coplanar with said horizontal cabinet surface, said pivot base extending generally along a longitudinal side of said frame, a generally planar surface carried by said pivot base, said planar surface being disposed relative to said pivot base and said frame such that it is generally coplanar with the upper surface of said lower arm when said frame is in said second position whereby said planar surface forms an auxiliary work supporting surface, said planar surface being responsive to relative movement between said pivot base and said frame whereby said planar surface is displaced from said lower arm when said frame is in said first position.

2. An assembly as set forth in claim 1 wherein the combined width of the upper surface of said arm and said planar surface substantially equals the front-to-rear dimension of said cut-out.

3. An assembly as set forth in claim 2, wherein the pivot base and frame are arranged to substantially close said cut-out in said first operational position.

4. An assembly as set forth in claim 2, wherein said planar surface is fixed to said pivot base.

5. An assembly as set forth in claim 4, wherein said pivot base extends generally longitudinally along the rear side of the frame, said first pivot axis being disposed adjacent the plane of the upper panel surface, said second pivot axis being disposed forward of said pivot axis and substantially below said horizontal panel surface when said frame is in said second operational position, said second pivot axis being adjacent said horizontal panel surface when said frame is in said first operational position whereby said pivot base is adapted to cause said frame to move forwardly relative to said cut-out when elevated from said second position to said first position.

6. An assembly as set forth in claim 5, wherein said second pivot axis is disposed below said lower arm.

7. An assembly comprising a cabinet and a sewing machine, said cabinet including a cabinet panel having an upper horizontal surface and a cut-out for reception of said sewing machine, said sewing machine including a frame and a pivot base, said frame having a vertical standard, a horizontal upper arm extending from the standard, a sewing head at the free end of the upper arm, a lowered cantilevered arm extending from the lower end of said vertical standard generally parallel to the upper arm, means pivotally mounting said pivot base on the cabinet for rotation about a first horizontal axis parallel to said lower arm, said pivot base having means for pivotally supporting said frame for rotation about a second axis spaced from and parallel to said first axis, first and second support surfaces on said lower arm spaced from each other and extending parallel to said first and second axes, said first support surface being engagable with said cabinet panel in a first position of said sewing machine to position said lower arm above said horizontal surface, said second support surface being engagable with said cabinet panel in a second position of said sewing machine where an upper face of said lower arm is generally coplanar with said horizontal cabinet surface, said first axis being located below said upper horizontal surface, said second axis being below said upper horizontal surface in said second position and said second axis being above said upper horizontal surface in said first position.

* * * * *